US006390065B2

(12) United States Patent
Almkvist

(10) Patent No.: US 6,390,065 B2
(45) Date of Patent: May 21, 2002

(54) METHOD OF REDUCTION OF COLD-START EMISSIONS FROM INTERNAL COMBUSTION ENGINES

(75) Inventor: Göran Almkvist, Gråbo (SE)

(73) Assignee: Volvo Car Corporation (SE)

( * ) Notice: Subject to any disclaimer, the term of this patent is extended or adjusted under 35 U.S.C. 154(b) by 0 days.

(21) Appl. No.: 09/781,134

(22) Filed: Feb. 10, 2001

Related U.S. Application Data

(63) Continuation of application No. PCT/SE99/01355, filed on Aug. 9, 1999.

(30) Foreign Application Priority Data

Aug. 10, 1998 (SE) ..... 9802694

(51) Int. Cl.[7] ..... F02D 41/04

(52) U.S. Cl. ..... 123/435; 123/436; 123/675; 123/491

(58) Field of Search ..... 123/675, 491, 123/436, 435

(56) References Cited

U.S. PATENT DOCUMENTS

| | | | | |
|---|---|---|---|---|
| 4,327,689 A | * | 5/1982 | Rachel | 123/491 |
| 4,683,856 A | * | 8/1987 | Matsuura et al. | 123/436 |
| 4,829,963 A | | 5/1989 | Oblaender et al. | |
| 5,605,132 A | | 2/1997 | Hori et al. | |
| 5,630,397 A | | 5/1997 | Shimizu et al. | |
| 5,715,796 A | | 2/1998 | Suzuki et al. | |
| 5,809,969 A | | 9/1998 | Fiaschetti et al. | |
| 5,901,684 A | * | 5/1999 | Fiaschetti et al. | 123/436 |
| 5,913,299 A | * | 6/1999 | Shimizu et al. | 123/436 |
| 6,173,698 B1 | * | 1/2001 | DeGroot et al. | 123/436 |

* cited by examiner

*Primary Examiner*—Erick Solis
(74) *Attorney, Agent, or Firm*—Kilpatrick Stockton LLP

(57) ABSTRACT

Method of reducing noxious or toxic exhaust emissions from an internal combustion engine (10) having a plurality of cylinders (12) cooperating with a crankshaft (13) to cause the crankshaft to rotate at a rotational speed when the cylinders (12) are provided with an air/fuel mixture having a lambda value and the mixture is ignited to generate pressure in the cylinders. The method includes measuring a parameter reflecting the pressure in a first cylinder during at least a part of a working stroke of the first cylinder when supplied with an air/fuel mixture having a first lambda value to thereby obtain a first parametric value. An air/fuel mixture is provided to a second cylinder, which air/fuel mixture has a second lambda value which is different to the first lambda value, to cause the second cylinder to perform a working stroke. A parameter is measured reflecting the pressure in the second cylinder during at least a part of the working stroke of the second cylinder to obtain a second parametric value. The parametric values are compared to obtain a parametric comparison value and the lambda value is adjusted for the air/fuel mixture to a subsequent cylinder dependent on the parametric comparison value.

10 Claims, 2 Drawing Sheets

METHOD OF REDUCTION OF COLD-START EMISSIONS FROM INTERNAL COMBUSTION ENGINES

RELATED PATENT APPLICATIONS

This is a continuation patent application of International Application No. PCT/SE99/01355, filed Aug. 9, 1999, that designates the United States, which claims priority to Swedish Application No. 9802694-1filed Aug. 10, 1998. The full disclosure of said applications, in their entirety, is hereby expressly incorporated by reference into the present application.

TECHNICAL FIELD

The present invention relates to a method for reducing noxious or toxic exhaust emissions from an internal combustion engine, particularly those emissions which are generated immediately after starting the engine from cold.

BACKGROUND OF THE INVENTION

In many countries, legislation dictates a permitted maximum level of exhaust gas emissions from vehicle engines. Typically, catalytic converters are employed to remove or reduce the levels of certain noxious or toxic emissions from exhaust gases. However, catalytic converters become efficient only once they reach their light-off temperature and therefore do not immediately contribute to a reduction of cold-start emissions. Conventional fuel delivery systems for internal combustion engines employ an exhaust gas oxygen sensor, commonly termed a lambda sensor, to determine the amount of oxygen in the exhaust gases and to adjust the amount of fuel delivered to the cylinders of the engine based on the value of the signal generated by the sensor. As with a catalytic converter, however, a lambda sensor can only begin to operate once it has reached a particular operating temperature.

It is during the period from cold-starting an engine until its catalytic converter reaches its light-off temperature that the vast majority of undesirable exhaust emissions is discharged to the atmosphere. Much research relating to the reduction of cold-start emissions from internal combustion engines is documented in patent literature. For example, in an attempt to compensate for the lack of a lambda sensor control signal during start-up from cold, it is proposed in WO-A-89/04917 to provide an engine control device in which a first datablock is programmed for operation in accordance with certain engine operating parameters but without lambda control when the engine is cold. A second datablock is programmed for operation with lambda control when the engine is warm. Switching logic switches in the first datablock when the engine is started below a lower threshold temperature and switches over to the second datablock when the temperature rises above a higher threshold temperature.

Due to variations in fuel quality, an engine is typically given a rich air-fuel mixture when being started and when running cold to ensure that smooth running of the engine is achieved without risk of the engine stalling. It is known from EP-A-0 807 751 to provide an engine with an after-start lean-burn control. To achieve smooth running of the engine when the after-start lean-burn control is switched in, the idling rotational speed of the engine is increased. EP-A-0 807 751 further proposes idling control apparatus which compensates for changes in engine torque as the after-start lean-burn control is switched in and out.

In GB-A-2 316 197, various problems associated with variations in fuel blends are identified. In order to operate an internal combustion engine smoothly during start-up and cold idling regardless of the fuel quality, it is proposed in that document to measure the rotational speed of the engine crankshaft and compare the measured speed with an expected engine speed. A speed error is then calculated and the amount of fuel delivered to be combusted in each of the cylinders is adjusted to reduce the speed error.

Although the arrangements discussed above may provide improved running characteristics for engines operating when cold, there still exists a need for cleaner exhaust gases when starting an engine from cold.

DISCLOSURE OF THE INVENTION

The present invention in its several disclosed embodiments alleviates the drawbacks described above with respect to conventionally designed methods for reducing cold-start emissions from internal combustion engine and incorporates additionally beneficial features.

In this regard, it is an object of the present invention to provide a method of reducing noxious or toxic exhaust emissions from an internal combustion engine without noticeably affecting smooth running of the engine. This objective is achieved in accordance with the present invention by reducing noxious or toxic exhaust emissions from an internal combustion engine. The engine has a plurality of cylinders that cooperate with a crankshaft to cause the crankshaft to rotate at a rotational speed when said cylinders are provided with an air/fuel mixture having a lambda value. The mixture is ignited to generate pressure in the cylinders. The method includes measuring a parameter reflecting the pressure in a first cylinder during at least a part of a working stroke of that first cylinder when supplied with an air/fuel mixture having a first lambda value to thereby obtain a first parametric value. An air/fuel mixture is provided to a second cylinder that has a second lambda value which is different from the first lambda value and which causes the second cylinder to perform a working stroke. A parameter is measured reflecting the pressure in the second cylinder during at least a part of the working stroke of the second cylinder to obtain a second parametric value. The first and second parametric values are compared to obtain a parametric comparison value. The lambda value is adjusted for the air/fuel mixture to a subsequent cylinder dependent on the parametric comparison value.

In one particularly advantageous embodiment of the invention, the parameter reflecting the pressure in the first cylinder is a first rotational acceleration value determined by measuring the rotational speed of the crankshaft at two instances during at least a part of the working stroke of the first cylinder. The parameter that reflects the pressure in the second cylinder is a second rotational acceleration value determined by measuring the rotational speed of the crankshaft at two instances during at least a part of the working stroke of the second cylinder. The parametric comparison value is a rotational acceleration comparison value attained by comparing the first rotational acceleration value with the second rotational acceleration value.

The method in accordance with the present invention can be utilized as soon as the engine is started; that is, during the first cycle. Since the method causes the engine to more quickly adopt a leaner mixture, a considerable reduction of hydrocarbon emissions is attained, as is a reduction in fuel consumption. Because the principle underlying the invention is based on a relative comparison of the different combustions, the method is insensitive to variations due to wear during the life of an engine, as well as being independent of external factors such as fuel, temperature, altitude, and the like.

The beneficial effects described above apply generally to the exemplary devices, mechanisms and methods disclosed herein for the present invention. The specific structures through which these benefits are delivered will be described in detail hereinbelow.

BRIEF DESCRIPTION OF THE DRAWINGS

The invention will now be described in greater detail in the following way, by example only, and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components or processes. Therefore, specific structural and functional details disclosed herein are not to be interpreted as limiting, but merely as a basis for the claims and as a representative basis for teaching one skilled in the art to variously employ the present invention.

Figure 1:
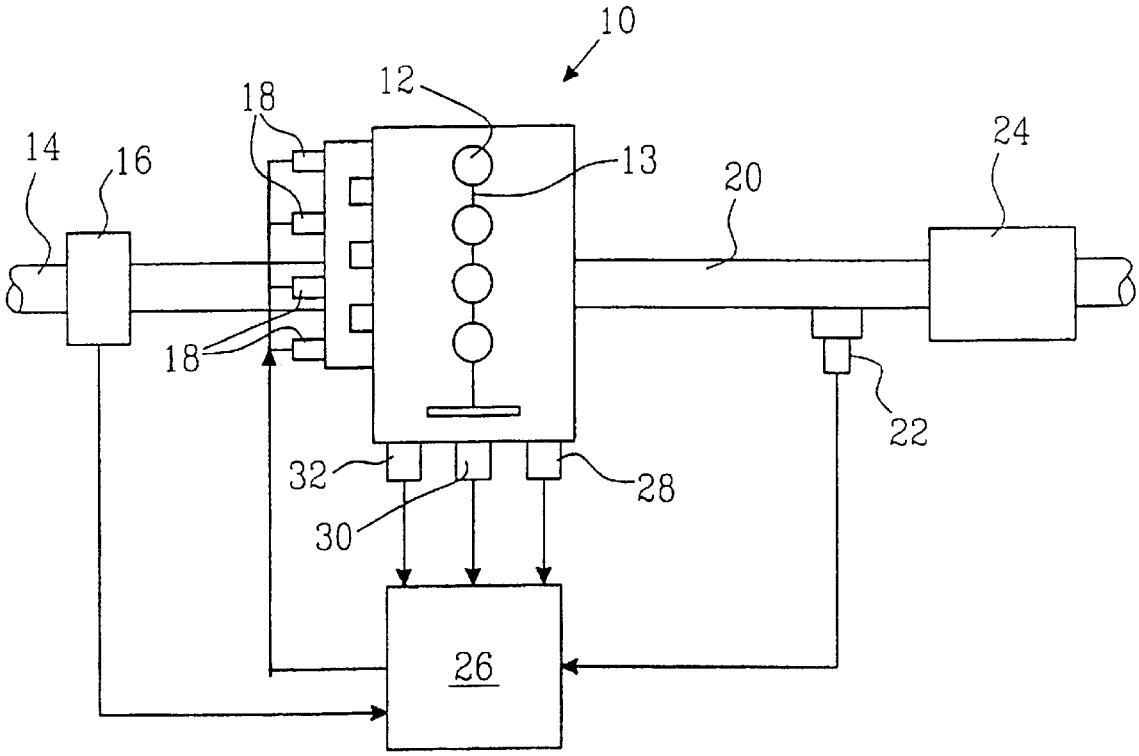
FIG. 1 is a schematic representation of an internal combustion engine on which the method according to the present invention is to be applied.

In FIG. 1, reference numeral 10 generally denotes an internal combustion engine which is subjected to the method (s) of the present invention. In a known manner, the internal combustion engine 10 comprises a plurality of cylinders 12 cooperating with a crankshaft 13. The engine 10 is supplied with air via an air intake passage 14. The amount of air entering the engine 10 is regulated by a throttle valve 16. Downstream of the throttle valve 16, fuel is discharged and mixed with the air from one or more injectors 18. Combustion of the air/fuel mixture in the cylinders 12 generates exhaust gases which are led along an exhaust pipe 20 past a lambda sensor 22 and through a catalytic converter 24 to the atmosphere. The engine is controlled by an electronic control unit (ECU) 26. The ECU receives signals from the throttle valve 16 and from sensors monitoring various parameters of the engine, for example the lambda sensor 22, a water temperature sensor 28, a crankshaft speed sensor 30 and an intake pressure sensor 32. On the basis of the signals from the various sensors, the ECU controls the amount of fuel to be injected via the one or more injectors 18.

Figure 2:
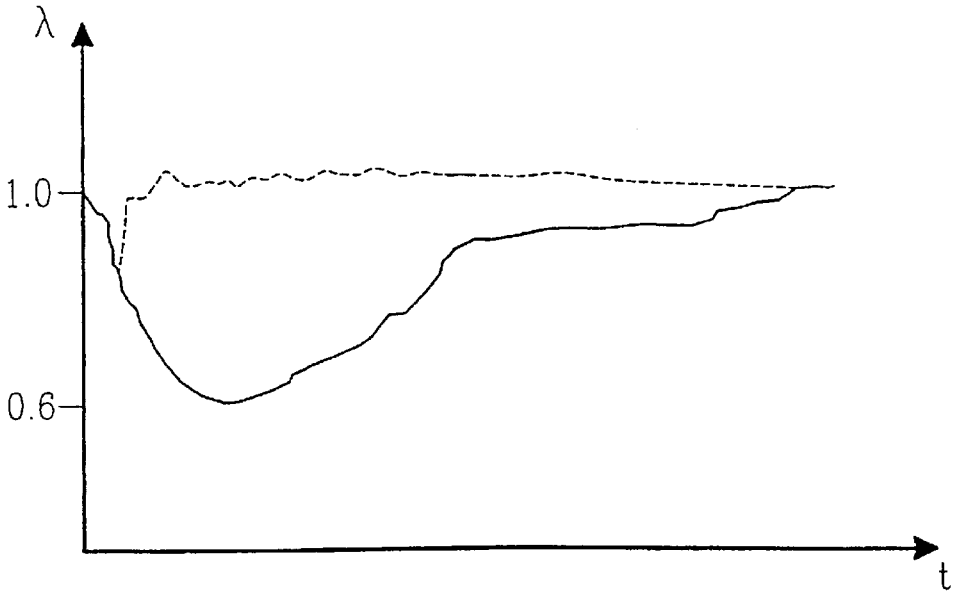
FIG. 2 is a schematic graphical representation of the lambda value plotted against time for a typical engine started from cold.

FIG. 2 is a graph of lambda against time immediately after starting an engine from cold. For the purposes of the present invention, an engine is said to be started from cold if its initial temperature is such that the lambda sensor is not yet at its operating temperature. The air number lambda is the actual air-to-fuel ratio divided by the stoichiometric air-to-fuel ratio. If the lambda value is greater than one, the engine is said to be running lean and if the lambda value is less than one, the engine is said to be running rich. The solid line in FIG. 2 depicts the variation in lambda for a typical engine which is not subjected to the method of the present invention. Thus, in order to compensate for variations in fuel quality, as well as to ensure that the engine will run smoothly even if high loads are placed on the engine such as from an air-conditioning pump or a servo-steering pump, the engine is initially set to run rich. As the engine warms up, the air/fuel mixture is gradually weakened until a signal is obtained from the lambda sensor and the lambda value can be maintained at about one.

The dashed line in FIG. 2 schematically represents the variation in the lambda value for an engine which is subjected to the method according to the present invention. In a manner which will be described in greater detail in the following, the engine is controlled such that the lambda value is brought to a value of about one more rapidly.

Figure 3:
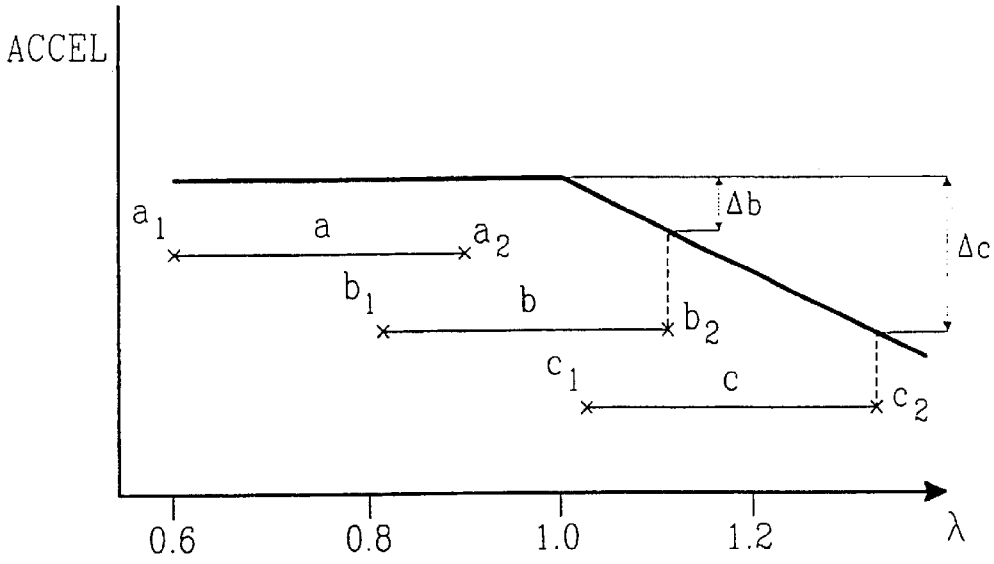
FIG. 3 is a schematic graphical representation of crankshaft acceleration which represents the engine torque plotted against lambda values for a typical engine.

A basic principle underlying the invention is that the pressure exerted on a piston in a cylinder during combustion of a fuel/air charge is substantially constant at lambda values of the fuel/air charge less than about one, though substantially inversely proportional to the lambda value for lambda greater than about one. Ignoring frictional losses, the torque produced by an engine is a measure of the pressure exerted on the pistons. Thus, the torque produced by an engine will be substantially constant at lambda values less than about one, though substantially inversely proportional to the lambda value for lambda greater than about one. An indication of the torque value can be obtained by measuring the rotational speed v of the engine's crankshaft at two instances during at least a part of a working stroke of one of the cylinders of the engine to obtain a rotational acceleration value. Correlating the measured rotational acceleration value to torque implies that a curve as schematically shown in FIG. 3 is obtained. Thus, it can be seen from FIG. 3 that for lambda values less than one; that is, when an engine is running rich, the torque of the engine is substantially constant. However, for lambda values greater than one when an engine is running lean, the torque of the engine decreases substantially linearly with increasing weakness of the air/fuel mixture.

The method in accordance with the present invention will be described in the following in which the rotational acceleration of the crankshaft during the working stroke of a cylinder is used as a parameter reflecting the pressure in the cylinder during combustion. It is to be understood, however, that any suitable parameter may be used. For example, it is feasible that each cylinder be provided with a pressure sensor in its combustion chamber and that possible variations in pressure as detected by the pressure sensor be used to adjust the lambda value to subsequent cylinders.

The method in accordance with the present invention comprises the following basic steps. Initially, the rotational acceleration of the crankshaft 13 of the engine 10 is measured during at least a part of a working stroke of at least a first cylinder 12 to obtain a first rotational acceleration value. For example, the rotational acceleration value may be determined by comparing a measurement of the rotational speed of the crankshaft at 48 degrees and 60 degrees ATDC. A second cylinder is then provided with an air/fuel mixture having a second lambda value, which is typically greater than the first lambda value, to cause the second cylinder to perform a working stroke. In other words, the second cylinder is provided with a weaker mixture than the first cylinder. Thereafter, the rotational acceleration of the crankshaft 13 is measured during at least a part of the working stroke of the second cylinder to obtain a second rotational acceleration value. This second rotational acceleration value is compared to the first rotational acceleration value to obtain a rotational acceleration comparison value. On the basis of the rotational acceleration value, the lambda value for the air/fuel mixture to a subsequent cylinder is adjusted.

Since and engine may be subjected to cyclic variations during running, the mixture administered to the second cylinder should be considerably weaker than that administered to the first cylinder, otherwise it would be impossible to determine whether a change in rotational acceleration of the crankshaft was due to a cyclic variation or to a weakening of the mixture. Thus, the second lambda value; that is, the lambda value of the supplied air/fuel mixture, should be between 10% and 100%, and preferably between 20% and 80%. Most preferably the lambda value of the supplied air/fuel mixture is between 30% and 60% greater than first lambda value. The actual difference between the first and second lambda values will be dependent on the actual engine operating conditions such as engine temperature and fuel wall film effects in any of the cylinders.

Based on the result of the rotational acceleration comparison value, one of three conclusions can be drawn. These are depicted in FIG. 3 by the lines a, b and c.

For line a, the point $a_1$ represents the rotational acceleration of the crankshaft when the first cylinder performs a working stroke when provided with an air/fuel mixture having the first lambda value. The point $a_2$ represents the rotational acceleration of the second cylinder as it performs a working stroke when provided with an air/fuel mixture having the second lambda value. Since the values of $a_1$ and $a_2$ are substantially equal; that is, the rotational acceleration comparison value is substantially zero, the conclusion can be drawn that the engine is running rich and that a further weakening of the mixture can be performed. Due to normal cyclic variations during the running of an engine, it is to be understood that the rotational acceleration comparison value will probably never be exactly zero. Thus, the expression "substantially zero" means that any difference between the values of $a_1$ and $a_2$ can be attributed to normal cyclic variations.

Should the rotational acceleration comparison value be large, for example as represented by $\Delta c$, it can be concluded that the rotational acceleration of the crankshaft at the second lambda value $c_2$ is much less than the acceleration at the first lambda value $c_1$ and hence the second lambda value is too high; that is, the engine is running too weak at the second lambda value and that a more appropriate lambda value for continued running of the engine is $c_1$.

The third possibility is depicted by line b in FIG. 3. Therein, the rotational acceleration comparison value $\Delta b$ is less than $\Delta c$. This indicates that the degree of weakening of the mixture when going from the first lambda value $b_1$ to the second lambda value $b_2$ is too great for optimal running of the engine and that a third lambda value slightly lower than $b_2$ should be used subsequently. Advantageously, the engine's ECU may be provided with a matrix from which third lambda values can be read dependent on the measured rotational acceleration comparison value.

Figure 4:
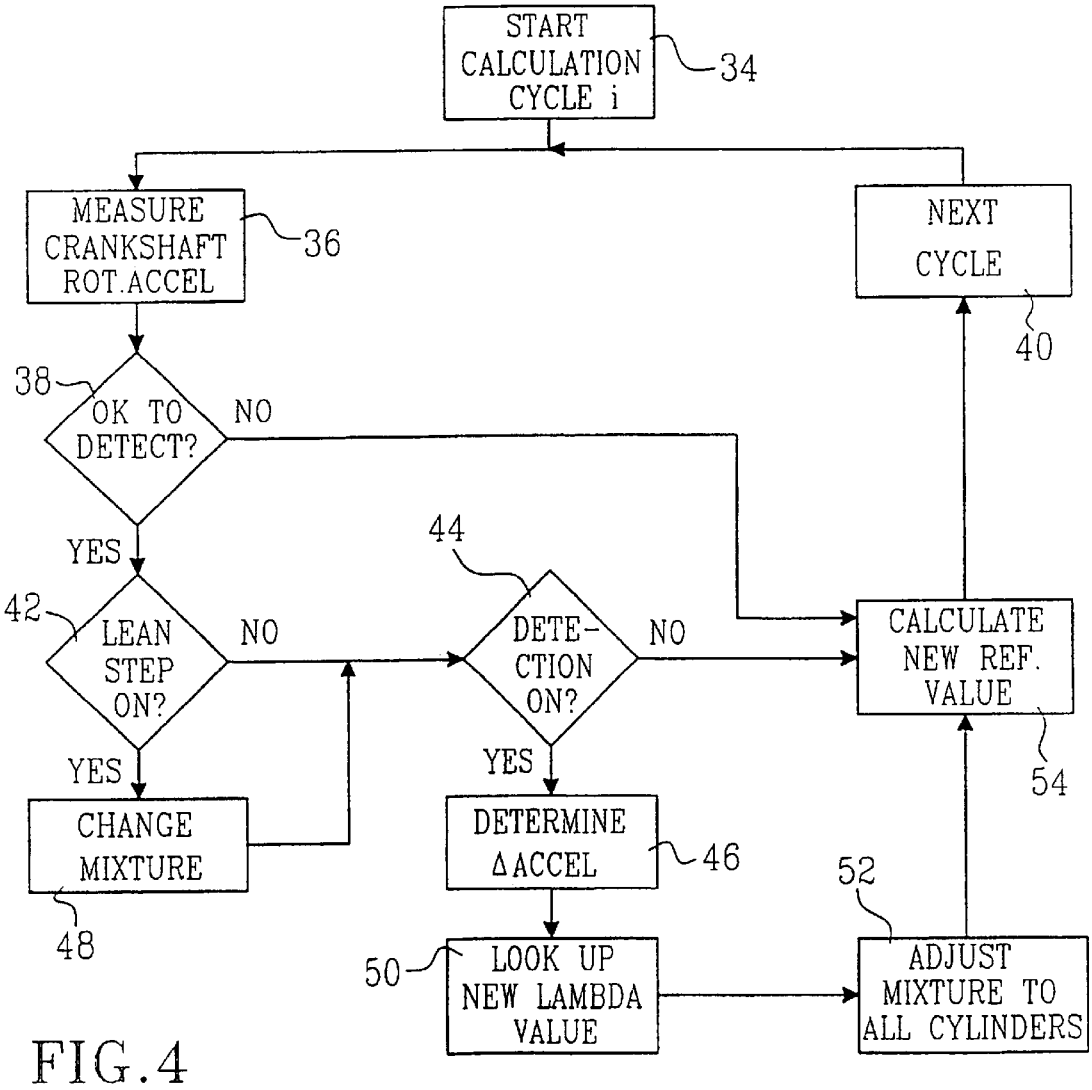
FIG. 4 is a flow chart depicting the method according to the present invention.

FIG. 4 depicts the method according to the present invention in the form of a flow chart. Box 34 represents the step of starting the calculation cycle to determine an appropriate lambda value for the air/fuel mixture to the engine. In order to avoid a wall film effect caused by unburnt fuel coating the cylinder walls, it is advantageous if the calculation cycle can be initially performed on a cylinder which has yet to perform a working stroke after engine start-up. Once at least one cylinder has fired, the rotational acceleration of the crankshaft is measured (box 36) to obtain a first rotational acceleration value. At box 38, the engine's ECU determines whether conditions are suitable for the method according to the invention to be performed. For example, if the engine is misfiring as a result of compression loss in a cylinder, it may be preferable to wait several seconds before weakening the air/fuel mixture. If the ECU determines that conditions are not favorable, the cycle proceeds to the next cycle (box 40).

Assuming that the ECU determines that the calculation cycle can be run, it must determine whether the cylinder in question is presently able to be subjected to a change in the lambda value of the supplied air/fuel mixture (box 42). If it is not, this may be due to the fact that the cylinder is presently performing a working stroke and that the rotational acceleration of the crankshaft is being measured (boxes 44 and 46). If the ECU determines that the cylinder in question may be subjected to a change in lambda value of the supplied air/fuel mixture, this step is performed at box 48. Due to the fact that, in a four-stroke engine, the crankshaft must rotate through two revolutions per cycle, detection of the crankshaft acceleration as a result of the change in the lambda value must be delayed until the cylinder in question has performed its intake stroke and compression stroke. This delay is effected at box 44.

Once the cylinder in question has performed its intake and compression stroke, the rotational acceleration of the crankshaft during at least a part of the working stroke to obtain a second rotational acceleration value can be performed to thereby determine a rotational acceleration comparison value $\Delta$accel (box 46). Based on the determined value $\Delta$accel, the ECU looks up a value for the subsequent lambda value (box 50). The air/fuel mixture to all cylinders is then adjusted to this subsequent lambda value at box 52. A new reference value (box 54) for lambda is then calculated for the subsequent calculation cycle (beginning box 40).

The procedure described above may be repeated until the ECU receives an operating signal from the lambda sensor. Account of such a signal is taken at box 38. Alternatively, the procedure can be performed even when the lambda sensor is functioning. In such a procedure, the mixture to each cylinder can be adjusted and the effect thereof measured to ensure that each cylinder receives an optimal air/fuel mixture irrespective of variations in manufacturing tolerances between cylinders and injectors for each cylinder. During such a procedure, the second lambda value need not necessarily be greater than the first lambda value. All that is necessary is that the values be sufficiently different to ensure that the measured values lie outside those which can be expected due to cyclic variations during the normal running of the engine.

It is to be understood that the invention is not restricted to the embodiments described above and shown in the drawings, but may be varied within the scope of the appended claims.

What is claimed and desired to be secured by Letters Patent is as follows:

1. A method of reducing noxious or toxic exhaust emissions from an internal combustion engine particularly immediately after cold starting the engine, said engine having a plurality of cylinders cooperating with a crankshaft to cause said crankshaft to rotate at a rotational speed when said cylinders are provided with an air/fuel mixture having a lambda value and said mixture is ignited to generate pressure in said cylinders, said method comprising the steps of:

measuring a parameter reflecting the pressure in a first cylinder during at least a part of a working stroke of said first cylinder when supplied with an air/fuel mixture having a first lambda value to thereby obtain a first parametric value;

providing an air/fuel mixture to a second cylinder, which air/fuel mixture has a second lambda value which is different to said first lambda value, to cause said second cylinder to perform a working stroke;

measuring a parameter reflecting the pressure in said second cylinder during at least a part of said working stroke of said second cylinder to obtain a second parametric value;

comparing said first parametric value with said second parametric value to obtain a parametric comparison value; and adjusting the lambda value for the air/fuel mixture to a subsequent cylinder dependent on said parametric comparison value.

2. The method as claimed in claim 1, wherein said parameter reflecting the pressure in said first cylinder is a first rotational acceleration value determined by measuring the rotational speed of the crankshaft at two instances during at least a part of the working stroke of said first cylinder, said parameter reflecting the pressure in said second cylinder is a second rotational acceleration value determined by measuring the rotational speed of the crankshaft at two instances during at least a part of the working stroke of said second cylinder, and said parametric comparison value is a rotational acceleration comparison value attained by comparing said first rotational acceleration value with said second rotational acceleration value.

3. The method as claimed in claim 2, wherein the step of adjusting the lambda value for the air/fuel mixture to a subsequent cylinder dependent on said rotational acceleration comparison value comprises increasing the lambda value when said rotational acceleration comparison value is substantially zero.

4. The method as claimed in claim 2, wherein the step of adjusting the lambda value for the air/fuel mixture to a subsequent cylinder dependent on said rotational acceleration comparison value comprises adjusting the lambda value to a third lambda value between said first lambda value and said second lambda value when said rotational acceleration comparison value exceeds a predetermined amount.

5. The method as claimed in claim 1, wherein said second lambda value is between 10% and 100% greater than said first lambda value.

6. The method as claimed in claim 5, wherein said second lambda value is between 20% and 80% greater than said first lambda value.

7. The method as claimed in claim 5, wherein said second lambda value is between 30% and 60% greater than said first lambda value.

8. The method as claimed in any one of claims 4, wherein said third lambda value is obtained from a matrix containing values for lambda dependent on the rotational acceleration comparison value.

9. The method as claimed in claim 1, wherein said engine is controlled by an electronic control unit to which a lambda sensor is connected and wherein said method is executed from engine start-up until an operating signal is sent to said electronic control unit from said lambda sensor.

10. The method as claimed in claim 1, wherein said engine is controlled from an electronic control unit and wherein said method is applied to each cylinder to ensure that each cylinder receives an optimal air/fuel mixture irrespective of variations in manufacturing tolerances between cylinders and injectors for each cylinder.

* * * * *

UNITED STATES PATENT AND TRADEMARK OFFICE

CERTIFICATE OF CORRECTION

PATENT NO. : 6,390,065 B2
DATED : May 21, 2002
INVENTOR(S) : Almkvist

It is certified that error appears in the above-identified patent and that said Letters Patent is hereby corrected as shown below:

Column 7,
Line 16, should read -- parametric value to obtain an instantaneous parametric comparison --
Line 19, should read -- subsequent cylinder dependent on said instantaneous parametric com- --

Signed and Sealed this

Twentieth Day of April, 2004

JON W. DUDAS
*Acting Director of the United States Patent and Trademark Office*